US008794576B2

(12) United States Patent
Tsai

(10) Patent No.: US 8,794,576 B2
(45) Date of Patent: Aug. 5, 2014

(54) KNOCKDOWN TABLE LEG OF GAME TABLE

(75) Inventor: Jerry Tsai, Taichung (TW)

(73) Assignee: Zhejiang Elephant Sport Co., Ltd., Jiashan, Zhejiang (CN)

( * ) Notice: Subject to any disclaimer, the term of this patent is extended or adjusted under 35 U.S.C. 154(b) by 205 days.

(21) Appl. No.: 13/589,595

(22) Filed: Aug. 20, 2012

(65) Prior Publication Data

US 2014/0048659 A1 Feb. 20, 2014

(51) Int. Cl.
*A47B 3/06* (2006.01)
*A47B 13/02* (2006.01)
*F16M 11/02* (2006.01)

(52) U.S. Cl.
USPC ..... 248/188.8; 248/165

(58) Field of Classification Search
CPC ..... F16M 11/02; A47B 3/06; A47B 13/02; A47B 47/0008; A47B 2200/0017; A47B 2200/0018; A47B 2230/0074; A47B 2230/0077; A47B 2230/0081; A47B 2230/0085; A47B 2230/0088; A47B 2230/0092; A47B 2230/0096; A47B 2230/01
USPC ..... 248/165, 188, 188.1, 188.2, 188.4, 248/188.6, 188.7, 188.8, 188.9, 346.3, 677, 248/688, 915; 473/4; 108/158.12, 159.12, 108/156, 190, 186
See application file for complete search history.

(56) References Cited

U.S. PATENT DOCUMENTS 705,653 A * 7/1902 Davis ..... 248/188.8
1,903,631 A * 4/1933 Morrison ..... 108/150
2,657,964 A * 11/1953 Watrous ..... 108/157.17
2,828,490 A * 4/1958 Howard ..... 5/310
3,166,100 A * 1/1965 Marius ..... 138/171
3,380,768 A * 4/1968 Wolfensberger ..... 52/280
3,714,908 A * 2/1973 Notko ..... 108/157.14
3,724,399 A * 4/1973 Notko et al. ..... 108/157.14
4,078,502 A * 3/1978 Barna ..... 108/150
4,102,276 A * 7/1978 Roveroni ..... 108/156
4,638,745 A * 1/1987 Sheffer ..... 108/192
4,746,088 A * 5/1988 Kruger ..... 248/188.8
5,163,373 A * 11/1992 Anderson et al. ..... 108/158.12
5,752,349 A * 5/1998 Fitzsimmons et al. ..... 52/165
5,758,856 A * 6/1998 Carnahan et al. ..... 248/523
6,234,434 B1 * 5/2001 Avinger ..... 248/188.7
6,776,380 B1 * 8/2004 Kirk et al. ..... 248/188
7,219,873 B2 * 5/2007 Harwood ..... 248/519
7,392,966 B1 * 7/2008 Chen ..... 248/188.8
7,744,160 B2 * 6/2010 Stolarov ..... 297/440.12
8,186,282 B1 * 5/2012 Sinchok et al. ..... 108/147.12

(Continued)

FOREIGN PATENT DOCUMENTS

CN 101692946 A * 4/2010
DE 3306661 A1 * 9/1984 ..... A61G 17/00

(Continued)

*Primary Examiner* — Terrell McKinnon
*Assistant Examiner* — Eret McNichols
(74) *Attorney, Agent, or Firm* — Guice Patents PLLC

(57) ABSTRACT

A knockdown table leg of game table includes a support frame, a front casing and a rear casing. The support frame has a connection section at a top end of the support frame. The lateral sides of the front and rear casings are connected with each other to form a hollow housing enclosing the support frame. The connection section of the support frame protrudes from the front and rear casings. A consumer can DIY assemble the table leg.

20 Claims, 14 Drawing Sheets

(56) References Cited

U.S. PATENT DOCUMENTS

| | | | | |
|---|---|---|---|---|
| 2002/0048744 | A1* | 4/2002 | London | 434/432 |
| 2003/0010738 | A1* | 1/2003 | Hsia et al. | 211/188 |
| 2005/0098693 | A1* | 5/2005 | Holt et al. | 248/188.2 |
| 2008/0258533 | A1* | 10/2008 | Stolarov | 297/440.1 |
| 2012/0080910 | A1* | 4/2012 | Davis | 297/118 |
| 2012/0235353 | A1* | 9/2012 | Chambless, III | 273/126 R |
| 2013/0019453 | A1* | 1/2013 | Berent et al. | 29/460 |
| 2013/0220188 | A1* | 8/2013 | Wei Siao | 108/158.11 |

FOREIGN PATENT DOCUMENTS

| | | | | | |
|---|---|---|---|---|---|
| DE | 9311385 | U1 | * | 7/1993 | |
| DE | 4135108 | C2 | * | 3/1994 | |
| GB | 2040672 | A | * | 9/1980 | F16B 2/02 |
| GB | 2092699 | A | * | 8/1982 | F16C 7/00 |
| JP | 2004173888 | A | * | 6/2004 | A47F 5/10 |

* cited by examiner

KNOCKDOWN TABLE LEG OF GAME TABLE

BACKGROUND OF THE INVENTION

1. Field of the Invention

The present invention relates generally to a game table, and more particularly to a knockdown table leg of a game table.

2. Description of the Related Art

In the modern society, leisure life has been more and more emphasized. Many people purchase game tables such as billiard tables or hockey game tables and place the game tables in the houses to achieve the objects of entertainment and exercise. FIG. 1 shows a conventional game table having a table face 11 and four table legs 12 fixedly disposed under the table face 11. Such game table is previously manufactured in a factory and then delivered to a store or a consumer's house. Therefore, when receiving the game table, the table legs 12 have been already fixedly connected with the table face 11. This makes it difficult to store or transfer the game table. Moreover, the table legs of the conventional game table have monotonous appearance without any beautifying effect.

There is a trend to DIY assembly. Therefore, manufacturers have tried to develop various knockdown game tables, which can be DIY assembled by the consumers. It is therefore tried by the applicant to provide a knockdown table leg of a game table, which has beautiful appearance and is easy for a consumer to DIY assemble.

SUMMARY OF THE INVENTION

It is therefore a primary object of the present invention to provide a knockdown table leg of a game table, which is easy for a consumer to DIY assemble.

It is a further object of the present invention to provide a knockdown table leg of a game table, which has rigid structure and beautiful appearance.

The table leg of the game table of the present invention includes a support frame, a front casing and a rear casing.

The support frame is a support with an L-shaped cross section. The support frame has a connection section at a top end of the support frame.

The front casing is composed of two front decoration boards containing a certain angle. Multiple first latch members are disposed on back faces of the two front decoration boards near inner sides thereof. The first latch members are latched with each other to connect the inner sides of the two front decoration boards.

The rear casing is composed of two rear decoration boards containing a certain angle. Multiple second latch members are disposed on inner wall faces of the two rear decoration boards near inner sides thereof. The second latch members are latched with each other to connect the inner sides of the two rear decoration boards.

The front and rear casings are assembled with the support frame from a front side and a rear side of the support frame respectively. Two lateral sides of the front casing are connected with two lateral sides of the rear casing. The connection section of the support frame upward protrudes from the front and rear casings.

Accordingly, a consumer can easily DIY assemble the table leg of the game table and the table leg has a rigid structure. The front and rear casings together form a housing and the table leg has a beautiful appearance.

Preferably, the support frame is composed of two upright boards. Abase seat is disposed between the two upright boards and positioned at the bottom end of the support frame. A pad member is connected with the base seat.

The lateral sides of the front casing and the lateral sides of the rear casing are connected by means of multiple connection components.

The support frame has two outer sides in the form of curved faces. The two front decoration boards have curved faces with raised/recessed sections corresponding to the curved faces of the two outer sides of the support frame, whereby the front decoration boards can be conveniently located on the support frame. Moreover, by means of the design of the curved faces, the table leg has a sculptural appearance.

At least one recess is formed on a back face of the support frame and the rear casing has at least one inward recess in alignment with the recess of the back corner of the support frame.

The present invention can be best understood through the following description and accompanying drawings, wherein:

DETAILED DESCRIPTION OF THE PREFERRED EMBODIMENTS

Figure 1:
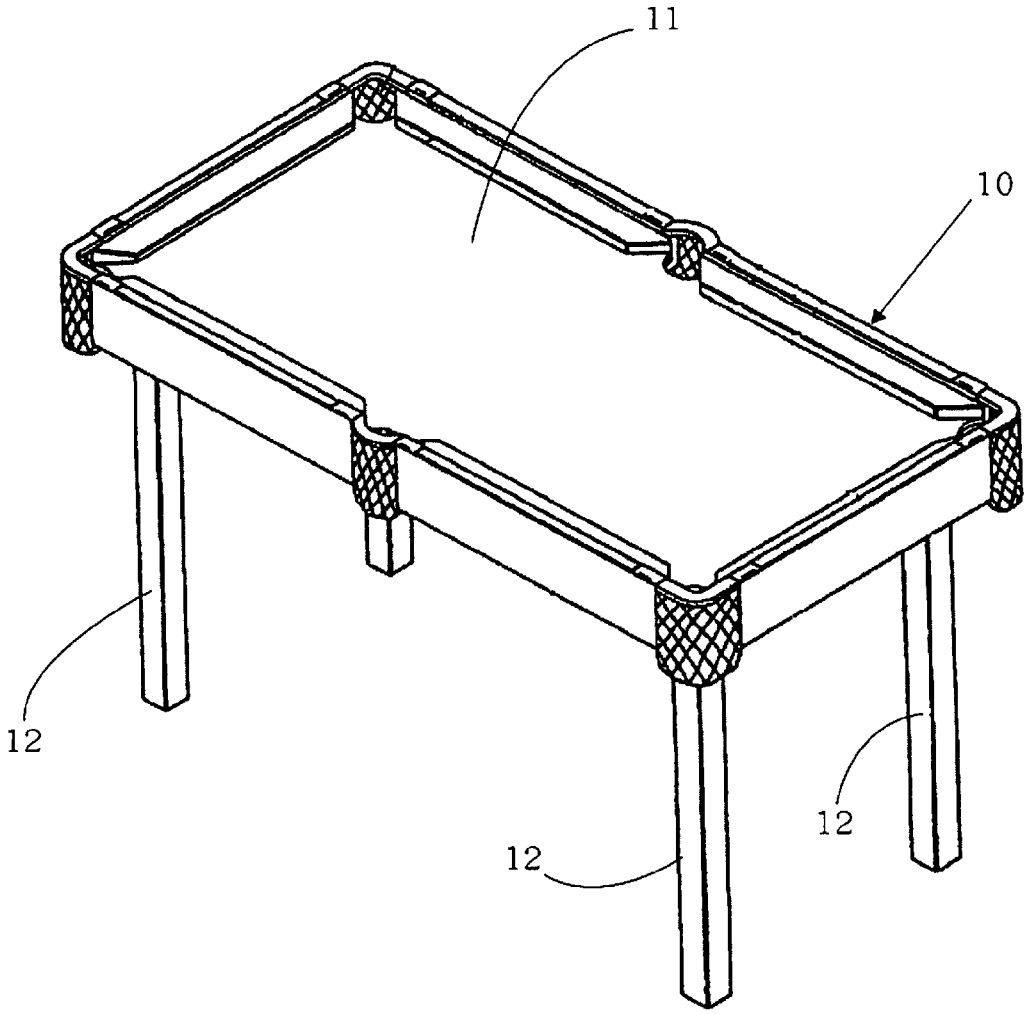
Fig.1 PRIOR ART
FIG. 1 is a perspective view of a conventional game table.
Figure 2:
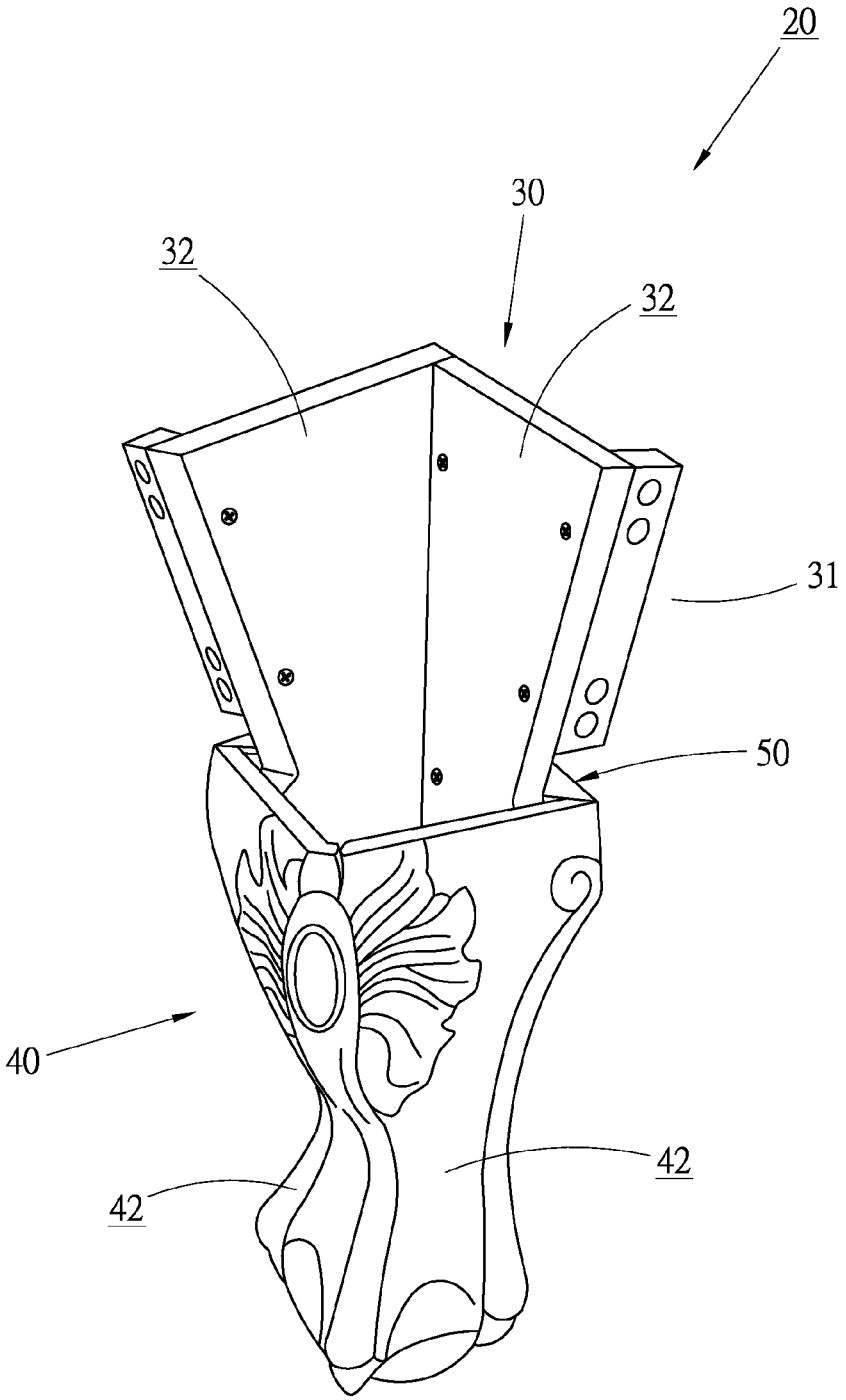
FIG. 2 is a perspective assembled view of a preferred embodiment of the knockdown table leg of the present invention.
Figure 3:
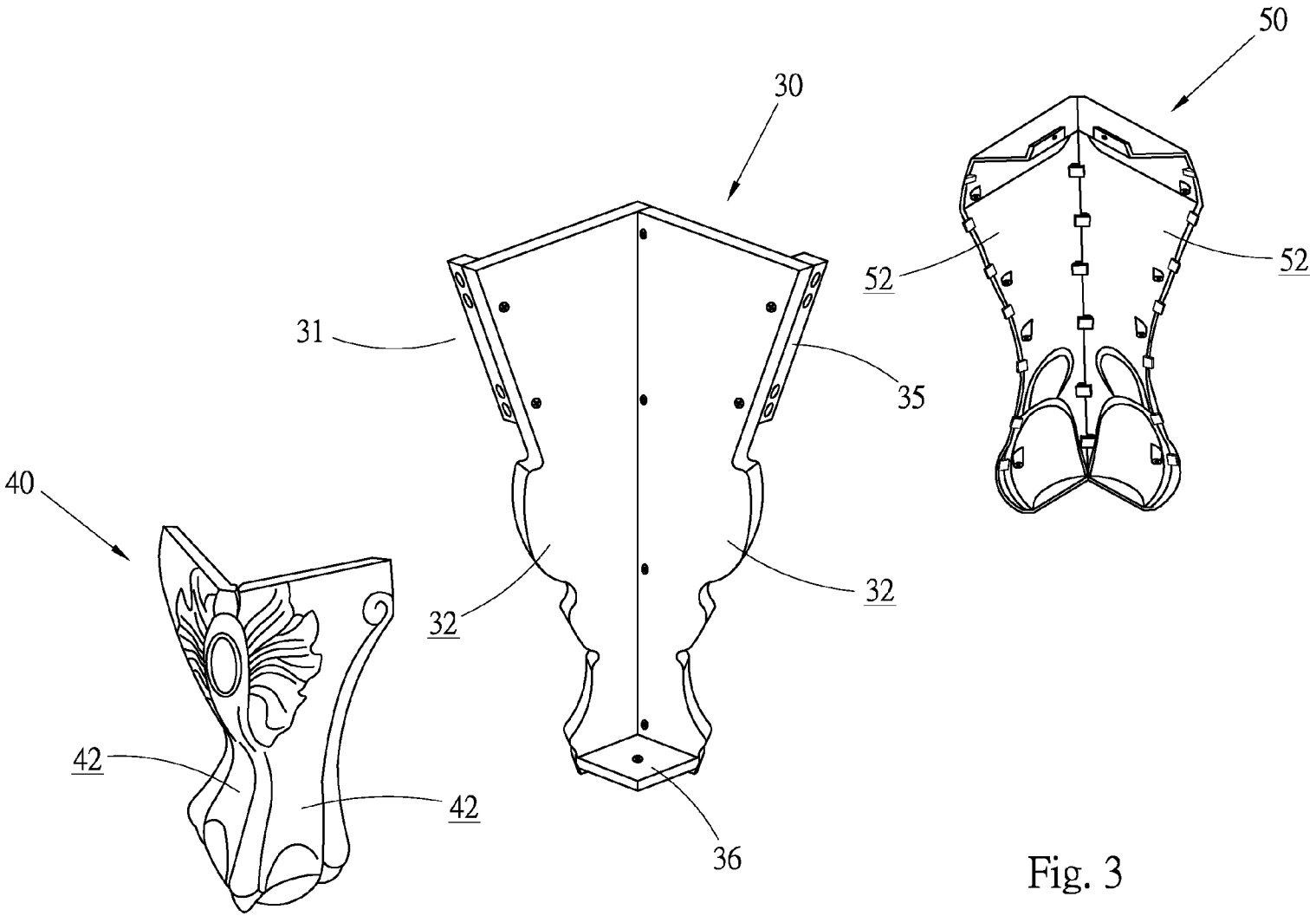
FIG. 3 is a perspective generally exploded view of the preferred embodiment of the table leg of the present invention.
Figure 4:
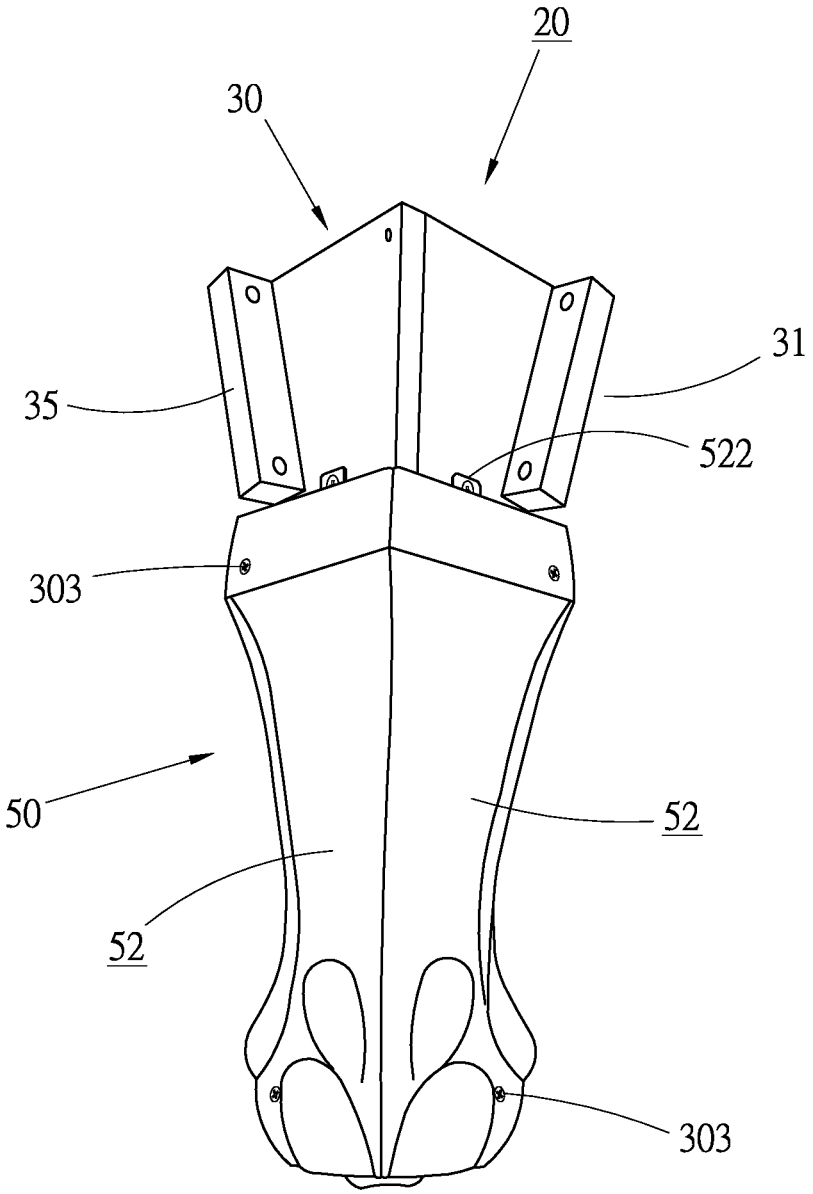
FIG. 4 is a rear perspective view of the preferred embodiment of the table leg of the present invention according to FIG. 2.
Figure 22:
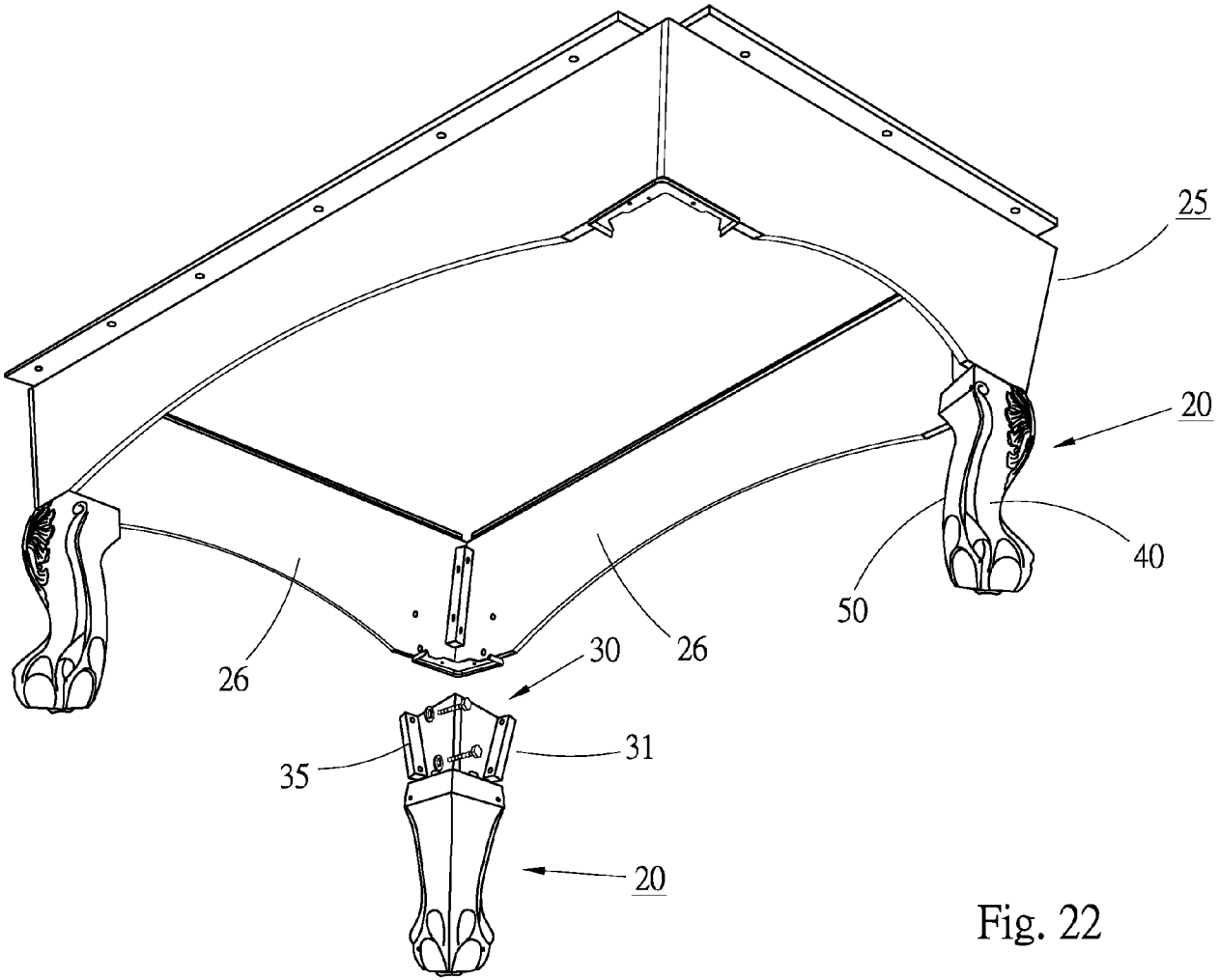
FIG. 22 is a perspective view showing that the table legs of the present invention are assembled with a table frame of a game table.

Please refer to FIGS. 2 and 3. According to a preferred embodiment, the knockdown table leg 20 of game table of the present invention includes a support frame 30 and a housing composed of a front casing 40 and a rear casing 50. A consumer can DIY assemble the support frame and the front and rear casings and assemble the front and rear casings around the support frame to form the table leg as shown in FIG. 2. The housing has an embossed surface so that the table leg 20 has a curved configuration and sculptural appearance. A top end of the support frame 30 protrudes from the housing to form a connection section 31. After the table leg is assembled, the consumer can assemble multiple table legs with the table frame 25 of a game table as shown in FIG. 22. The outward protruding connection section 31 of the table leg serves to connect with the table frame 25.

Figure 5:
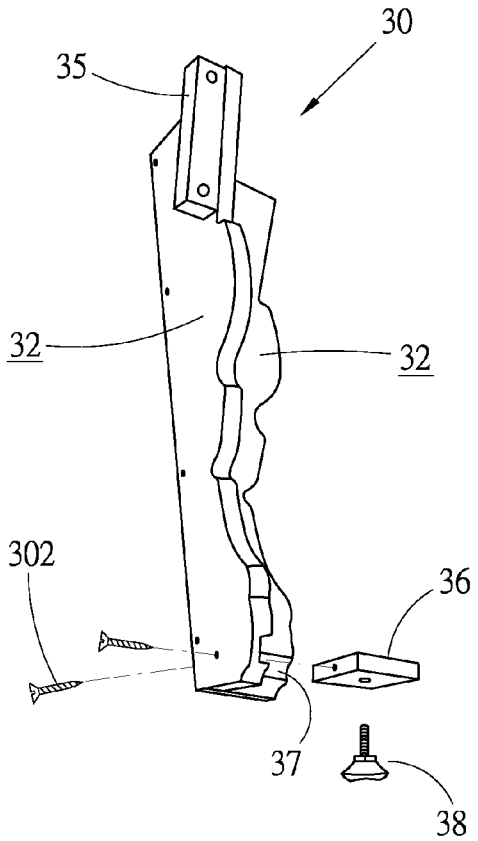
FIG. 5 is a side view of the support frame of the preferred embodiment of the table leg of the present invention.
Figure 6:
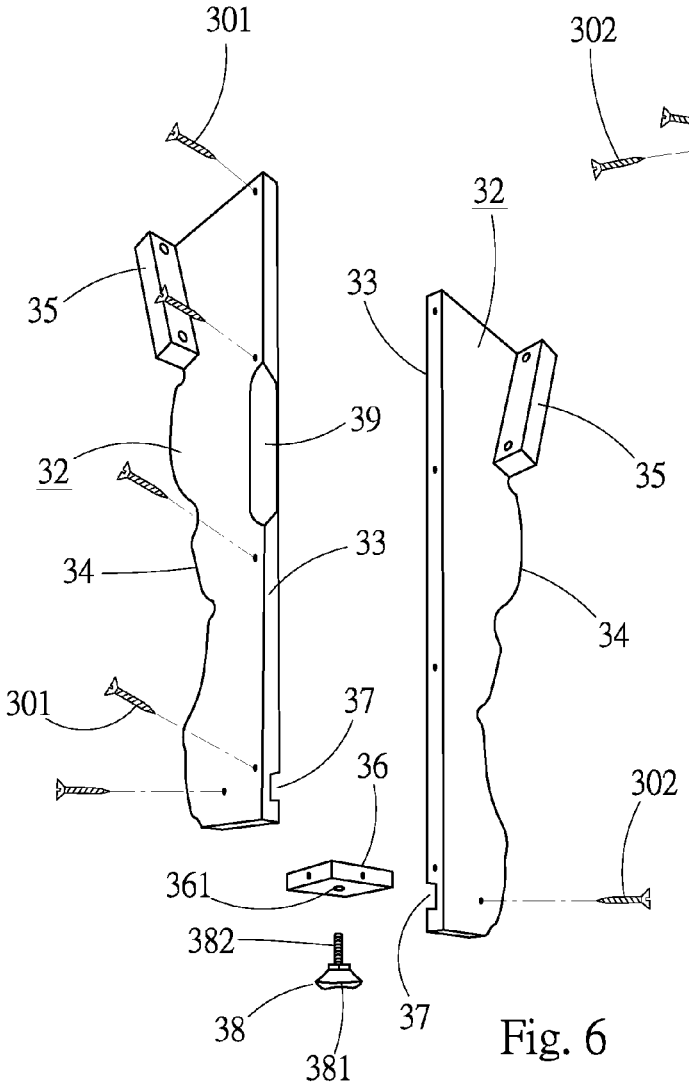
FIG. 6 is a rear perspective exploded view of the support frame of the preferred embodiment of the table leg of the present invention.
Figure 7:
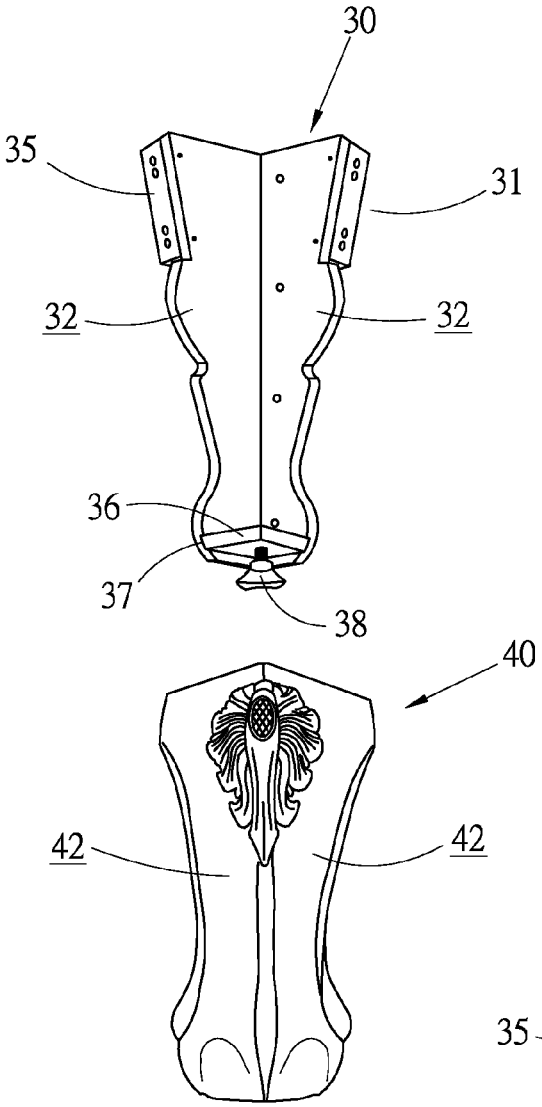
FIG. 7 is a perspective exploded view of the support frame and the front casing of the preferred embodiment of the table leg of the present invention.
Figure 8:
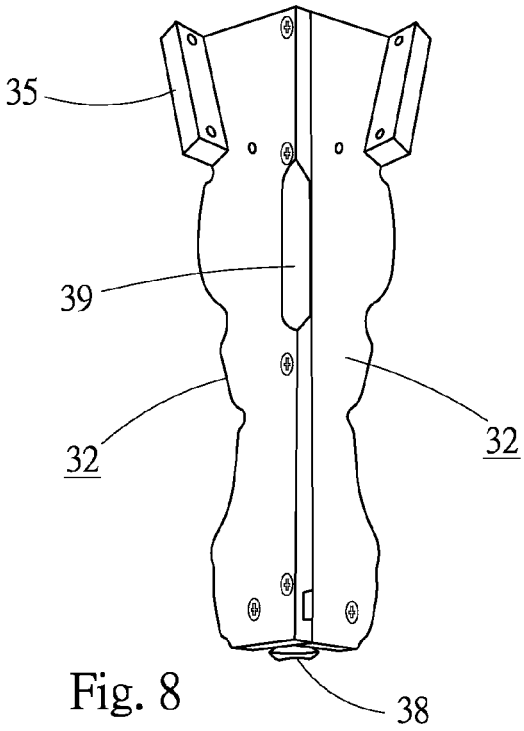
FIG. 8 is a rear perspective assembled view of the support frame of the preferred embodiment of the table leg of the present invention.

The support frame 30 is a support with an L-shaped cross section. The support frame 30 is composed of two upright boards 32 connected with each other. Please refer to FIGS. 5 and 6. Each upright board 32 has an inner side 33, which is a straight side and an outer side 34, which is a curved side having raised/recessed sections. Each upright board 32 has a top end, which is a protruding section with a certain height. The top ends of the upright boards 32 together form the connection section 31. A connection block 35 is disposed on outer wall face of the protruding section of the upright board 32 in flush with outer edge of the upright board. The inner sides 33 of the two upright boards 32 are fixedly connected by means of fastening members 301 (such as screws or nails) to form the support frame 30. The outer sides 34 of the two upright boards form two lateral edges of the support frame 30. The support frame 30 has a base seat 36, which is a rectangular block. Two adjacent sides of the base seat 36 are respectively inserted in insertion channels 37 formed on inner wall faces of bottom ends of two upright boards 32. The base seat 36 is fixedly connected with the two upright boards 32 by means of two fastening members 302. The base seat 36 serves to increase structural strength of the support frame 30. A pad member 38 is mounted under the base seat 36 as shown in FIG. 7. Referring to FIGS. 5 and 6, the pad member 38 has a soft pad body 381 and a threaded rod 382 screwed in a threaded hole 361 formed on the base seat 36. The pad member 38 serves as a bottom end of the table leg 20 in contact with the ground. The pad member 38 can be rotated to adjust the height of the table leg. In addition, as shown in FIG. 8, at least one recess 39 is formed on a corner (the junction between the two upright boards) of a back face of the support frame 30.

Figure 9:
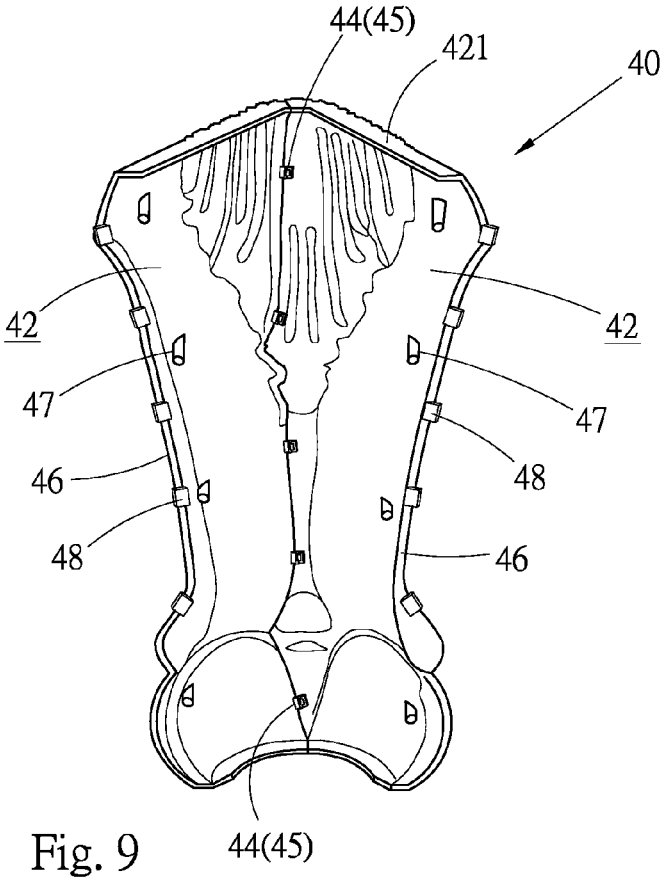
FIG. 9 is a rear perspective assembled view of the front casing of the preferred embodiment of the table leg of the present invention.
Figure 10:
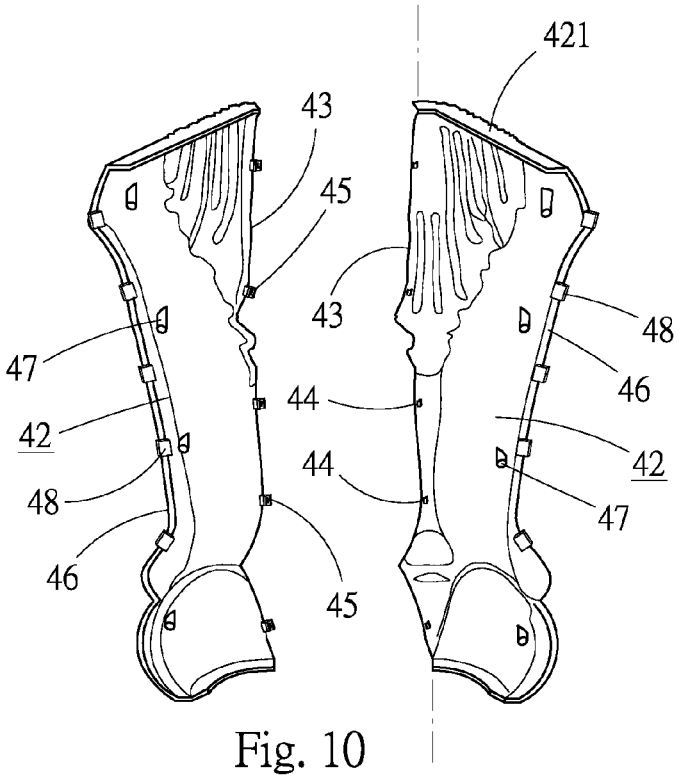
FIG. 10 is a rear perspective exploded view of the front casing of the preferred embodiment of the table leg of the present invention.
Figure 11:
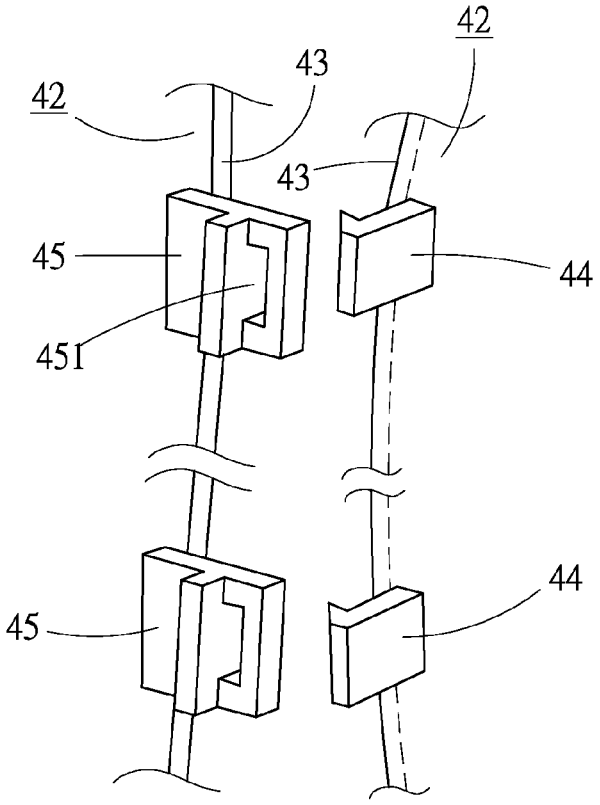
FIG. 11 is an enlarged view of the latch members of the front decoration boards of the preferred embodiment of the table leg of the present invention.
Figure 12:
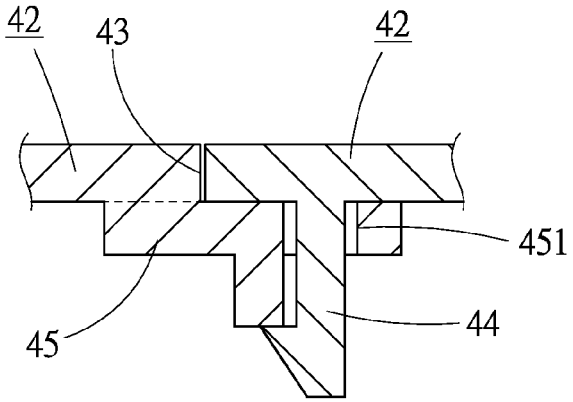
FIG. 12 is a sectional view of the latch members of the front decoration boards, in which the latch members are latched with each other.

The front casing 40 has an L-shaped or semicircular cross section. The front casing 40 is composed of two upright front decoration boards 42 containing a certain angle. The front decoration boards 42 are made of plastic material by injection molding and have curved and embossed outer surfaces with raised/recessed sections. Please refer to FIGS. 9 and 10. The front decoration board 42 has a maximum width at a top end, a second largest width at a bottom end and a minimum width in the middle. A top board section 421 inward extends from a top edge of the front decoration board. Inner edges 43 of the two front decoration boards 42 correspond to each other and can be connected with each other. Multiple first latch members including male latch members 44 and female latch members 45 are respectively disposed on back faces of the two front decoration boards near the inner sides 43. Please refer to FIGS. 11 and 12. Each male latch member 44 is a latch member having a reverse hook. Each female latch member 45 has a latch hole 451. The male latch members 44 are respectively passed through the latch holes 415 of the female latch members 45 to latch with the female latch members so as to assemble the two front decoration boards into the front casing 40. After assembled, the two inner sides 43 are tightly mated with each other and the inner sides of the two top board sections 421 are also in tight contact with each other. Several insertion pillars 47 are disposed on the back faces of the front decoration boards 42 near the outer sides 46. The outer sides 46 are two lateral sides of the front casing 40. Several first tongue sections 48 are respectively disposed on inner wall faces of the outer sides 46 of the front decoration boards 42. The free ends of the first tongue sections 48 protrude from the outer sides of the front decoration boards.

Figure 13:
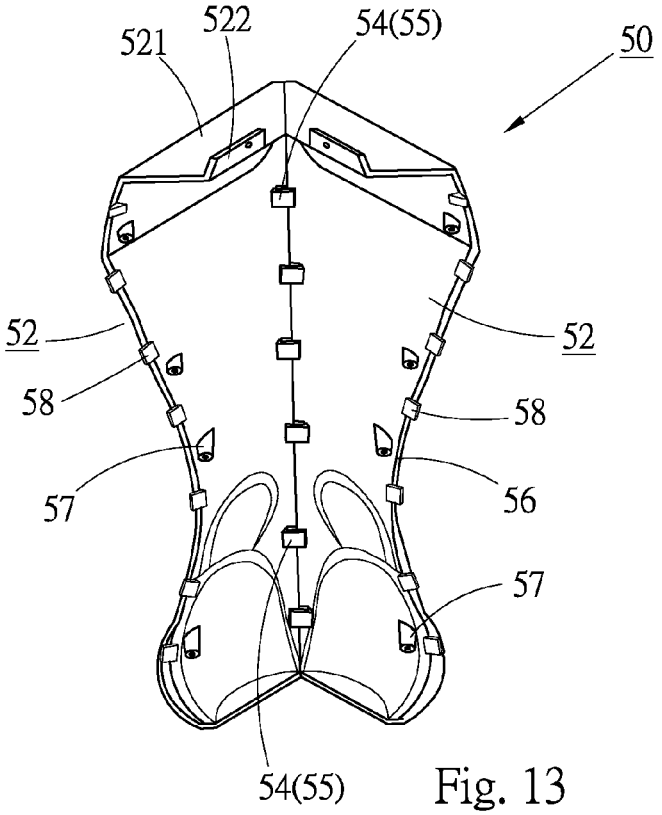
FIG. 13 is a rear perspective assembled view of the rear casing of the preferred embodiment of the table leg of the present invention.
Figure 14:
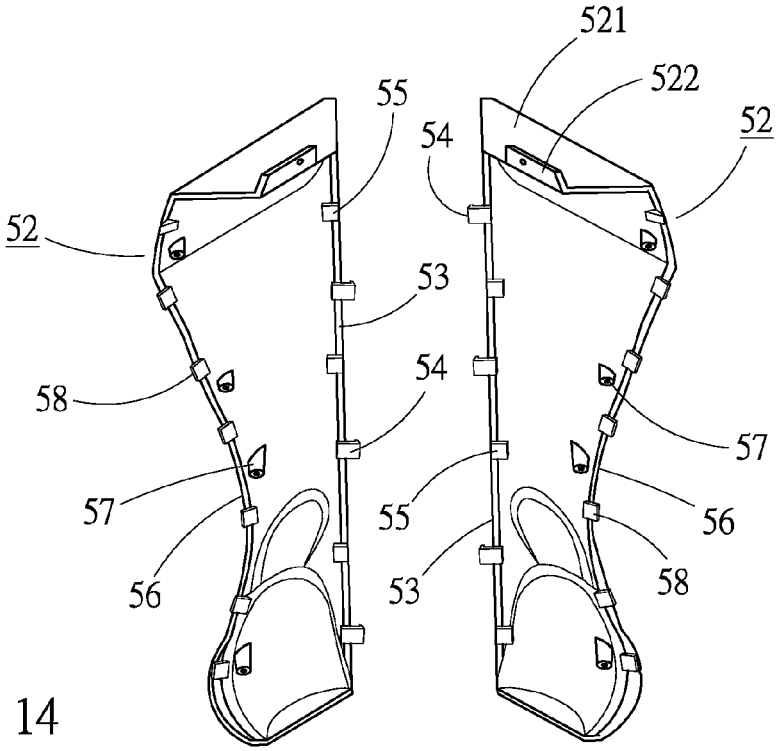
FIG. 14 is a rear perspective exploded view of the rear casing of the preferred embodiment of the table leg of the present invention.
Figure 15:
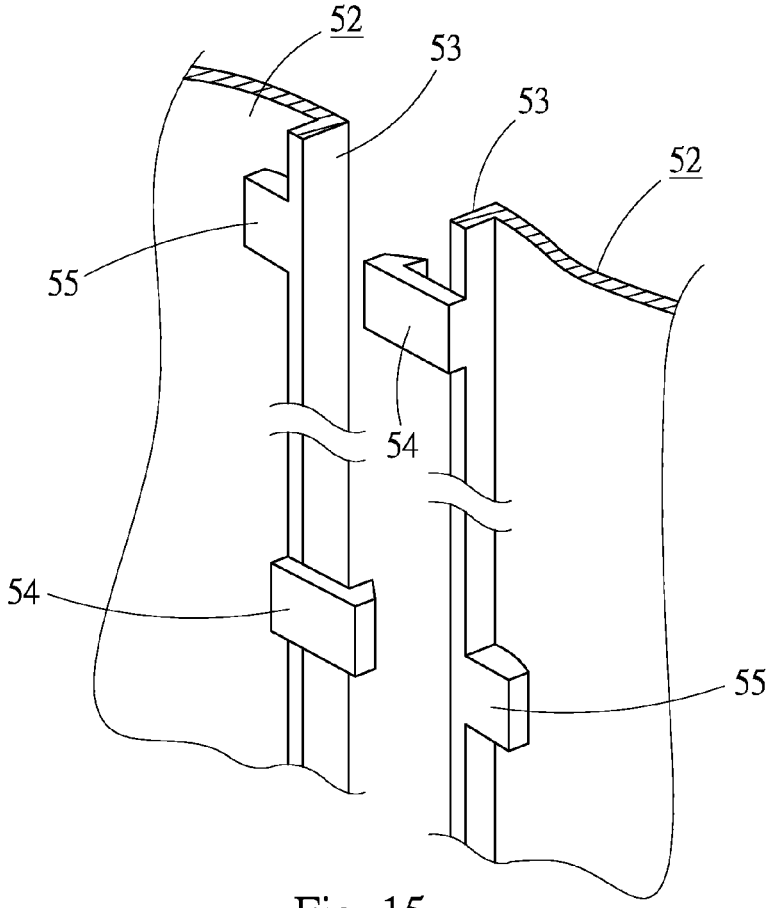
FIG. 15 is an enlarged view of the latch members of the rear decoration boards of the preferred embodiment of the table leg of the present invention.
Figure 16:
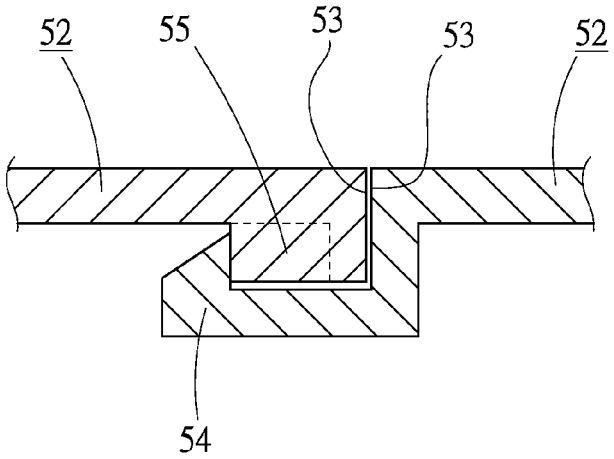
FIG. 16 is a sectional view of the latch members of the rear decoration boards, in which the latch members are latched with each other.

The rear casing 50 has an L-shaped or semicircular cross section. The rear casing 50 is composed of two upright rear decoration boards 52 containing a certain angle. Similarly, the rear decoration boards 52 are made of plastic material by injection molding and have curved outer surfaces with raised/recessed sections. Please refer to FIGS. 13 and 14. The rear decoration board 52 has a maximum width at a top end, a second largest width at a bottom end and a minimum width in the middle. A top board section 521 inward extends from a top edge of the rear decoration board. A connection plate 522 upward extends from the top board section 521. Inner edges 53 of the two rear decoration boards 52 correspond to each other and can be attached to and connected with each other. Multiple second latch members including several latching members 54 and several latched members 55 are alternately respectively disposed on inner wall faces of the two rear decoration boards near the inner sides 53. That is, some of the latching members 54 are disposed on one of the rear decoration boards, while the other latching members 54 are disposed on the other of the rear decoration boards. Please refer to FIGS. 15 and 16. Each latching member 54 is a latch member having a reverse hook. When the two rear decoration boards 52 are assembled, the latching members 54 are respectively latched with the latched sections 55 to assemble the two rear decoration boards into the rear casing 50. The latching members 54 of one rear decoration board 52 are respectively latched with the latched sections 55 of the other rear decoration board 52. Therefore, the two rear decoration boards are latched with each other without easy detachment. After assembled, the two inner sides 53 are tightly attached to each other. The inner sides of the two top board sections 521 are also in tight contact with each other. Therefore, the two rear decoration boards 52 are tightly connected with each other. Several hollow insertion pillars 57 are disposed on the inner wall faces of the rear decoration boards 52 near the outer sides 56. The hollow insertion pillar 57 has an inner diameter larger than the outer diameter of the insertion pillar 47 of the front casing. The outer sides 56 are two lateral sides of the rear casing 50. Several second tongue sections 58 are respectively disposed on inner wall faces of the outer sides 56 of the rear decoration boards 52. The free ends of the second tongue sections 58 protrude from the rear decoration boards.

Figure 17:
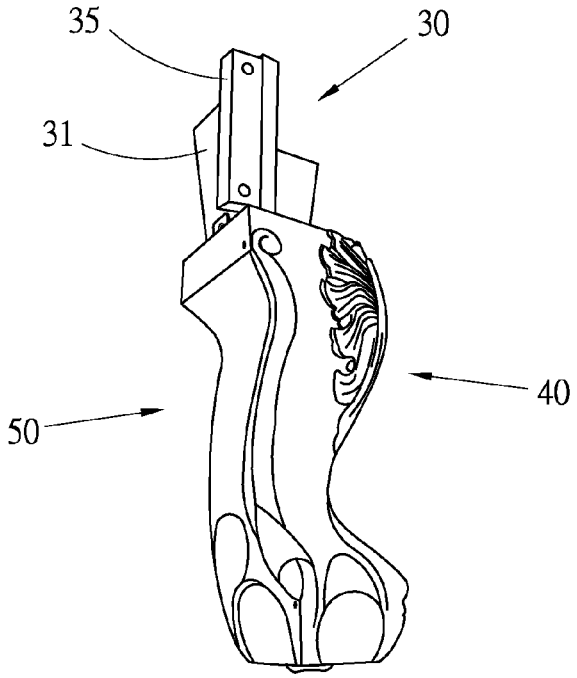
FIG. 17 is a side perspective view of the preferred embodiment of the table leg of the present invention.
Figure 18:
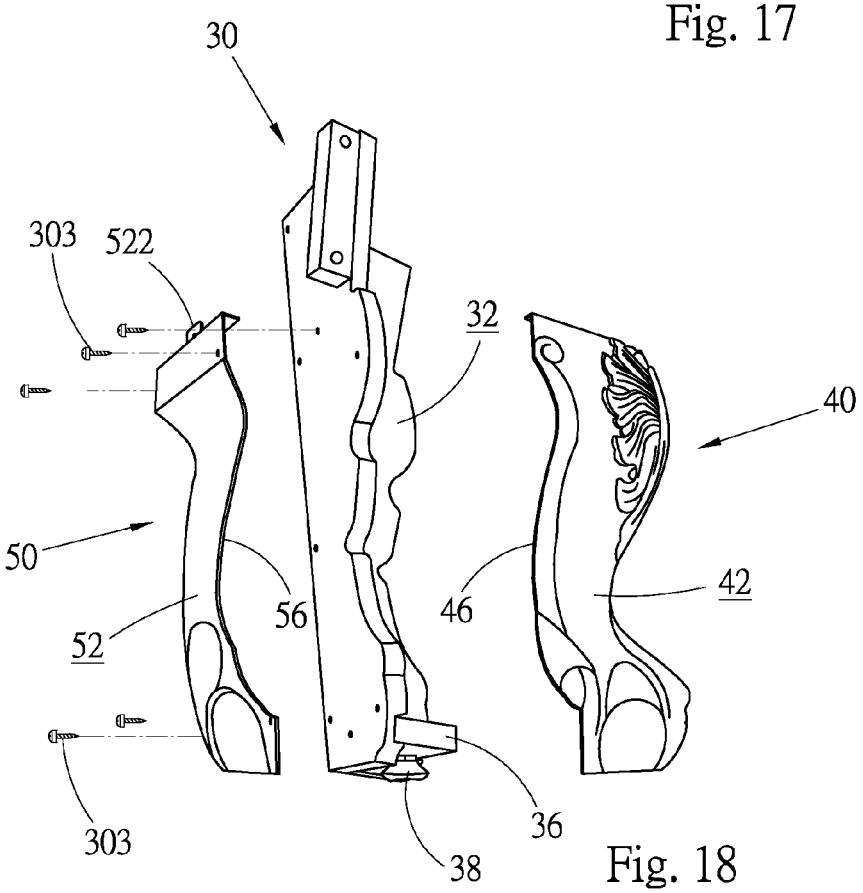
FIG. 18 is a perspective exploded view according to FIG. 17.

After the front casing 40 and the rear casing 50 are respectively assembled, the front and rear casings 40, 50 are assembled with the support frame 30. As shown in FIGS. 17 and 18, the two lateral sides of the front casing 40 are connected with the two lateral sides of the rear casing 50 to form a hollow housing enclosing the support frame 30 to form the table leg 20. The housing has the configuration of a quadrangular column as the appearance of the table leg. The connection section 31 protrudes from the housing. The connection section 31 has an L-shaped cross section and has two board sections. The insertion pillars 47 of the front casing 40 and the insertion pillars 57 of the rear casing 50 serve as connection components for connecting the lateral sides of the front and rear casings.

Figure 19:
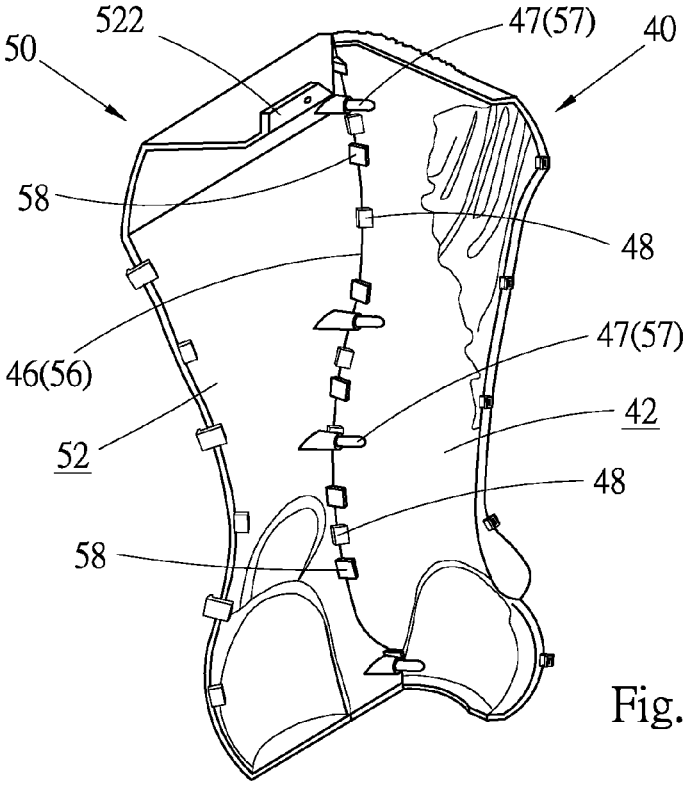
FIG. 19 is a perspective assembled view of a front decoration board and a rear decoration board of the preferred embodiment of the table leg of the present invention.
Figure 20:
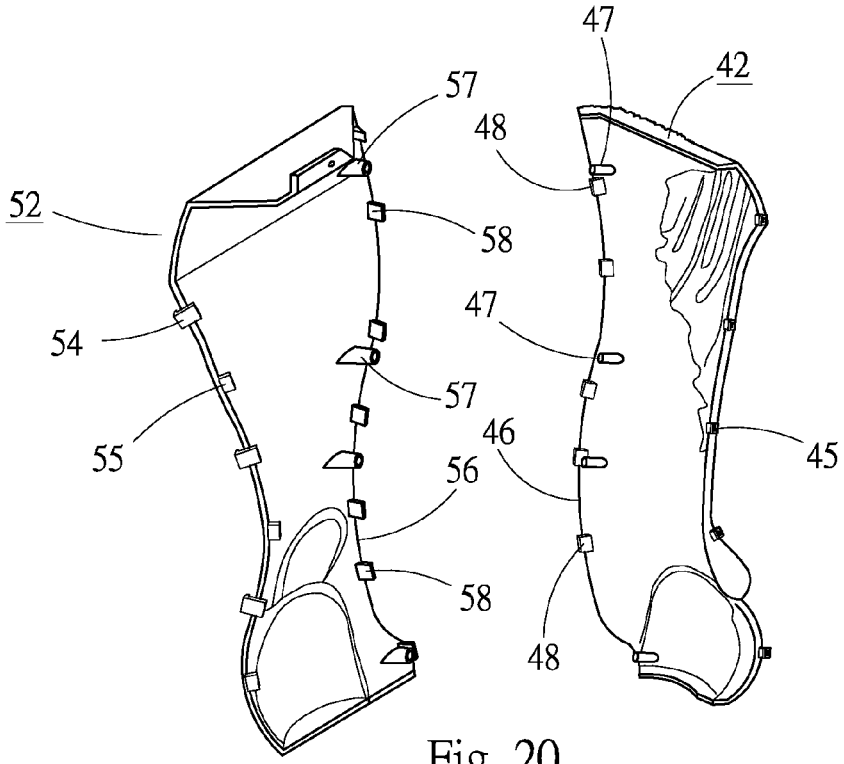
FIG. 20 is a perspective exploded view of a front decoration board and a rear decoration board of the preferred embodiment of the table leg of the present invention.

FIGS. 19 and 20 only show one front decoration board 42 and one rear decoration board 52 for easy illustration of the connection between the front and rear casings. When connecting the front and rear casings 40, 50, the outer sides 46, 56 of the front and rear decoration boards 42, 52 on the same side are connected with each other. The insertion pillars 47 of the front decoration board are inserted into the insertion pillars 57 of the rear decoration board. The tongue sections 48, 58 of the front and rear decoration boards 42, 52 are alternately arranged. The free ends of the first tongue sections 48 of the front decoration board 42 abut against the inner wall face of the rear decoration board 52, while the free ends of the second tongue sections 58 of the rear decoration board 52 abut against the inner wall face of the front decoration board 42. Accordingly, the front and rear casings are locked with each other with the lateral sides mated with each other. Under such circumstance, the front and rear decoration boards are securely assembled with each other. After the front and rear casings 40, 50 are connected with each other, several fastening members 303 (such as screws) are used to fixedly connect the rear casing 50 with the support frame 30 as shown in FIG. 18. Also, the connection plates 522 of the rear casing 50 are locked with the support frame by means of fastening members 303. In addition, as shown in FIG. 19, a fastening member 303 is screwed into the uppermost insertion pillars 47, 57 and a fastening member 303 is screwed into the lowermost insertion pillars 47, 57 to securely lock the front and rear casing with each other.

Figure 21:
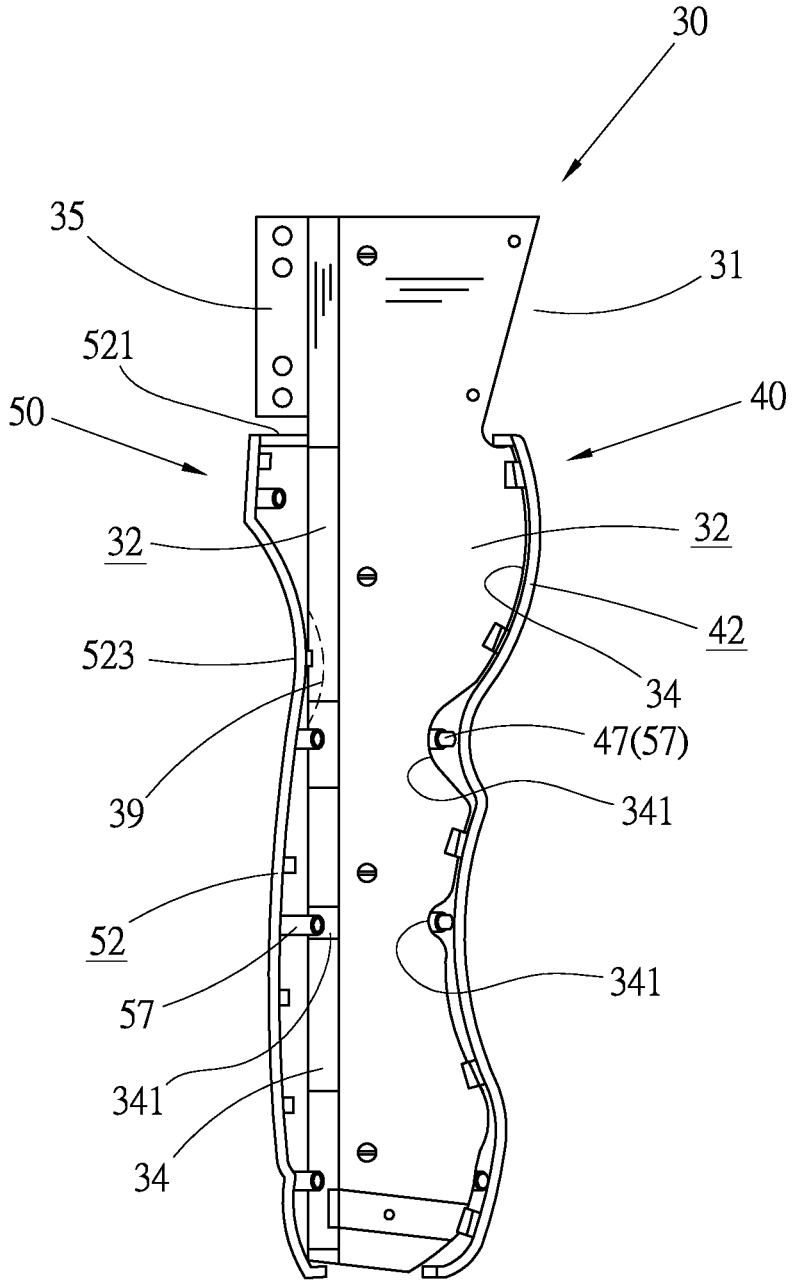
FIG. 21 is a side perspective view of the preferred embodiment of the table leg of the present invention, in which a front decoration board is removed.

Please further refer to FIG. 21. After the front and rear casings 40, 50 are assembled with the support frame 30, the curved faces of the front decoration boards 42 are snugly attached to the curved sides 34 of the upright boards 32. In addition, the curved sides 34 are formed with several recesses 341 for receiving the insertion pillars 47, 57 and permitting the insertion pillars 47, 57 to pass through the support frame. By means of such design, when assembled, it is easy to align the front casing 40 with the front side of the support frame 30. The rear casing 50 has a recess 523 right in alignment with the recess 39 of the back corner of the support frame. In this case, the rear casing 50 is also easy to align with the rear side of the support frame.

Referring to FIG. 22, after the table leg is assembled, the connection section 31 of the table leg 20 is connected with the table frame 25 of the game table to form the game table. The two connection blocks 35 of the two board sections of the connection section 31 are respectively connected with two board materials 26 of the table frame by means of screws. After assembled, the connection section 31 of the table leg is concealed in the table frame 25 and only the front and rear casings 40, 50 with beautiful appearances are exposed to outer side. The front casing is directed outward, while the rear casing is positioned on inner side.

The table leg of the present invention is a knockdown structure. A consumer can DIY assemble the table leg. After assembled, the table leg of the present invention has a rigid structure and sculptural appearance with beautifying effect. The knockdown table leg can save room and lower transfer cost.

The above embodiments are only used to illustrate the present invention, not intended to limit the scope thereof. Many modifications of the above embodiments can be made without departing from the spirit of the present invention. For example, alternatively, the connection components can be latch members instead of the insertion pillars of the front and rear casings. Similarly, the first and second latch members can be replaced with insertion pillars. In addition, the structures of the connection components and the first and second latch members can be exchanged. For example, the first latch members can have the structure of the second latch members and the connection components can have the structures of the first latch members or the second latch members.

What is claimed is:

1. A knockdown table leg of game table, comprising:

a support frame, which is a support with an L-shaped cross section, the support frame having a connection section at a top end of the support frame and a base seat disposed at a bottom end of the support frame and connected with two inner wall faces of the support frame;

a front casing composed of two front decoration boards containing a certain angle; multiple first latch members being disposed on back faces of the two front decoration boards near inner sides thereof; the first latch members being latched with each other to connect the inner sides of the two front decoration boards;

a rear casing composed of two rear decoration boards containing a certain angle; multiple second latch members being disposed on inner wall faces of the two rear decoration boards near inner sides thereof; the second latch members being latched with each other to connect the inner sides of the two rear decoration boards; and the front and rear casings being assembled with the support frame from a front side and a rear side of the support frame, two lateral sides of the front casing being connected with two lateral sides of the rear casing; the connection section of the support frame upward protruding from the front and rear casings.

2. The knockdown table leg as claimed in claim 1, wherein the support frame includes two upright boards, inner sides of the two upright boards being connected with each other; an insertion channel being formed on an inner wall face of a bottom end of each upright board; two adjacent sides of the base seat being inserted in the insertion channels of the two upright boards.

3. The knockdown table leg as claimed in claim 2, wherein the base seat is formed with a threaded hole; a pad member being mounted under the base seat, the pad member having a threaded rod at a top end, the threaded rod being screwed in the threaded hole of the base seat.

4. The knockdown table leg as claimed in claim 1, further comprising multiple connection components disposed on the lateral sides of the front casing and the lateral sides of the rear casing, the connection components being connected with each other to connect the lateral sides of the front casing with the lateral sides of the rear casing.

5. The knockdown table leg as claimed in claim 1, wherein multiple insertion pillars are disposed on outer sides of the front decoration boards and multiple insertion pillars are also disposed on outer sides of the rear decoration boards, the insertion pillars of the front decoration boards are plug-in connected with the insertion pillars of the rear decoration boards to connect the lateral sides of the front casing with the lateral sides of the rear casing.

6. The knockdown table leg as claimed in claim 1, further comprising multiple first tongue sections respectively disposed on inner wall faces of the outer sides of the front decoration boards, free ends of the first tongue sections protruding from the outer sides of the front decoration boards, and multiple second tongue sections respectively disposed on inner wall faces of the outer sides of the rear decoration boards, free ends of the second tongue sections protruding from the outer sides of the rear decoration boards, whereby when the front casing is connected with the rear casing, the free ends of the first tongue sections of the front decoration boards abut against the inner wall faces of the corresponding rear decoration boards, while the free ends of the second tongue sections of the rear decoration boards abut against the inner wall faces of the corresponding front decoration boards.

7. The knockdown table leg as claimed in claim 1, wherein two connection plates are respectively disposed on two sides of a top end of the rear casing, the connection plates being locked with the support frame by means of fastening members.

8. The knockdown table leg as claimed in claim 1, wherein the connection section of the support frame has an L-shaped cross section; two connection blocks being respectively disposed on two outer wall faces of the connection sections.

9. The knockdown table leg as claimed in claim 1, wherein the support frame has two outer sides in the form of curved faces; the two front decoration boards having curved faces with raised/recessed sections corresponding to the curved faces of the two outer sides of the support frame.

10. The knockdown table leg as claimed in claim 4, wherein the support frame has two outer sides, which are curved sides in the form of curved faces, each curved side having at least one recess for receiving the connection components.

11. The knockdown table leg as claimed in claim 1, wherein at least one recess is formed on a back face of the support frame and the rear casing has at least one inward recess in alignment with the recess of the back face of the support frame.

12. The knockdown table leg as claimed in claim 1, wherein the second latch members include multiple latching members respectively disposed on inner sides of the two rear decoration boards; each rear decoration board of the rear decoration boards latching with the other rear decoration board of the rear decoration boards by the latching members.

13. The knockdown table leg as claimed in claim 12, wherein the second latch members further include multiple latched members respectively disposed on the inner sides of the two rear decoration boards, the latching members of each rear decoration board being latched with the latched members of the other rear decoration board.

14. The knockdown table leg as claimed in claim 1, wherein the first latch members include male latch members and female latch members respectively disposed on the inner sides of the two front decoration boards, the male and female latch members being latched with each other to connect the inner sides of the two front decoration boards.

15. The knockdown table leg as claimed in claim 1, wherein the rear casing is connected with the support frame by means of multiple fastening members.

16. A knockdown table leg of game table, comprising:

a support frame having a connection section at a top end of the support frame, the connection section having an L-shaped cross section having two board sections;

a front casing having an L-shaped or semicircular cross section having two lateral sides;

a rear casing having an L-shaped or semicircular cross section having two lateral sides;

multiple connection components disposed on the lateral sides of the front and rear casings;

the front and rear casings being assembled with the support frame from a front side and a rear side of the support frame, the two lateral sides of the front casing being connected with the two lateral sides of the rear casing by means of the connection components to form a hollow housing enclosing the support frame; and the connection section of the support frame protruding from the front and rear casings.

17. The knockdown table leg as claimed in claim 16, further comprising multiple first tongue sections respectively disposed on inner wall faces of the lateral sides of the front casing, free ends of the first tongue sections protruding from the lateral sides of the front casing, and multiple second tongue sections respectively disposed on inner wall faces of the lateral sides of the rear casing, free ends of the second tongue sections protruding from the lateral sides of the rear casing, whereby when the front casing is connected with the rear casing, the free ends of the first tongue sections of the front casing abut against the inner wall faces of the rear casing, while the free ends of the second tongue sections of the rear casing abut against the inner wall faces of the front casing.

18. The knockdown table leg as claimed in claim 16, wherein a base seat is disposed at a bottom end of the support frame, and a pad member being mounted under the base seat.

19. The knockdown table leg as claimed in claim 16, wherein multiple insertion pillars are disposed between the lateral sides of the front casing and the rear casing; the lateral sides of the front and rear casings are connected with each other by means of the insertion pillars.

20. The knockdown table leg as claimed in claim 16, wherein the support frame has a front face in the form of curved face; the front casing having a curved face corresponding to the curved face of the support frame.

* * * * *